US012276213B2

(12) United States Patent
Lahr et al.

(10) Patent No.: US 12,276,213 B2
(45) Date of Patent: Apr. 15, 2025

(54) VALVE TRAIN FOR AN INTERNAL COMBUSTION ENGINE, IN PARTICULAR OF A MOTOR VEHICLE, AND INTERNAL COMBUSTION ENGINE

(71) Applicant: DAIMLER TRUCK AG, Leinfelden-Echterdingen (DE)

(72) Inventors: Matthias Lahr, Schwäbisch Gmünd (DE); Patrick Rohde, Esslingen (DE)

(73) Assignee: DAIMLER TRUCK AG, Leinfelden-Echterdingen (DE)

( * ) Notice: Subject to any disclaimer, the term of this patent is extended or adjusted under 35 U.S.C. 154(b) by 0 days.

(21) Appl. No.: 18/711,993

(22) PCT Filed: Nov. 21, 2022

(86) PCT No.: PCT/EP2022/082596

§ 371 (c)(1),
(2) Date: May 21, 2024

(87) PCT Pub. No.: WO2023/089169

PCT Pub. Date: May 25, 2023

(65) Prior Publication Data

US 2025/0003358 A1 Jan. 2, 2025

(30) Foreign Application Priority Data

Nov. 22, 2021 (DE) ..... 10 2021 005 779.1

(51) Int. Cl.
*F01L 1/26* (2006.01)
*F01L 1/18* (2006.01)
(Continued)

(52) U.S. Cl.
CPC ..... *F01L 1/26* (2013.01); *F01L 1/181* (2013.01); *F01L 1/46* (2013.01); *F01L 13/06* (2013.01)

(58) Field of Classification Search
CPC ..... F01L 1/181; F01L 1/26; F01L 1/46; F01L 13/06
(Continued)

(56) References Cited

U.S. PATENT DOCUMENTS 4,537,165 A * 8/1985 Honda ..... F01L 13/0005 123/90.46
5,570,664 A 11/1996 Nohara
(Continued)

FOREIGN PATENT DOCUMENTS

DE 3415245 A1 12/1984
DE 4308535 A1 10/1993
(Continued)

OTHER PUBLICATIONS

International search report for PCT/EP2022/082596 mailed on Mar. 9, 2023.

*Primary Examiner* — Jorge L Leon, Jr.
(74) *Attorney, Agent, or Firm* — Dennemeyer & Associates LLC

(57) ABSTRACT

The invention relates to a valve train (10) for an internal combustion engine, having a first rocker arm (32) which is mounted on a rocker shaft (30) so as to be pivotable around a pivot axis (44) in relation to the rocker shaft (30), having a first gas exchange valve (18) which can be actuated by pivoting the rocker arm (32) around the pivot axis (44) in relation to the rocker shaft (30) and can thus be moved translationally, and having a second gas exchange valve (20). An intermediate piece (50) is provided which is formed separately from the first rocker arm (32) and mounted on the rocker shaft (30) so as to be pivotable around the pivot axis (44) in relation to the rocker shaft (30), can be actuated by pivoting of first rocker arm (32) around the pivot axis (44) and in relation to the rocker shaft (30) by means of the first rocker arm (32) and can thus be pivoted around the pivot
(Continued)

axis (44) in relation to the rocker shaft (30), whereby the second gas exchange valve (20) can be actuated and can thus be moved translationally.

7 Claims, 3 Drawing Sheets

(51) Int. Cl.
*F01L 1/46* (2006.01)
*F01L 13/06* (2006.01)

(58) Field of Classification Search
USPC ..... 123/90.4, 90.44
See application file for complete search history.

(56) References Cited

U.S. PATENT DOCUMENTS

| | | | | |
|---|---|---|---|---|
| 5,682,847 | A | 11/1997 | Hara | |
| 2009/0044771 | A1* | 2/2009 | Ezaki | F01L 13/0036 123/90.22 |
| 2019/0055861 | A1 | 2/2019 | Persson | |

FOREIGN PATENT DOCUMENTS

| | | | |
|---|---|---|---|
| EP | 1761686 | B1 | 3/2007 |
| JP | S59231118 | A | 12/1984 |
| KR | 1020150135152 | A * | 12/2015 |

* cited by examiner

VALVE TRAIN FOR AN INTERNAL COMBUSTION ENGINE, IN PARTICULAR OF A MOTOR VEHICLE, AND INTERNAL COMBUSTION ENGINE

CROSS-REFERENCE TO RELATED APPLICATIONS

This is a 35 U.S.C. 371 National Stage Patent Application of International Application No. PCT/EP2022/082596, filed Nov. 21, 2022, which claims priority to German application 10 2021 005 779.1, filed Nov. 22, 2021, each of which is hereby incorporated by reference in its entirety.

DISCLOSURE

The invention relates to a valve train for an internal combustion engine, in particular of a motor vehicle, according to the preamble of claim 1. Furthermore, the invention relates to an internal combustion engine for a motor vehicle according to the preamble of claim 7.

A system for actuating at least one engine valve is taken as known from EP 1 761 686 BI, wherein a gas exchange valve can be actuated with two rocker arms.

The object of the present invention is to create a valve train for an internal combustion engine, as well as an internal combustion engine having such a valve train, such that a particularly advantageous actuation of the gas exchange valves, and a simple construction of the valve train can be realised.

This object is solved by a valve train having the features of claim 1, as well as by an internal combustion engine having the features of claim 7. Advantageous embodiments with expedient developments of the invention are provided in the remaining claims.

A first aspect of the invention relates to a valve train for an internal combustion engine, preferably formed as a reciprocating piston motor or reciprocating piston engine and also referred to as a combustion engine, in particular of a motor vehicle. This means that when it is fully assembled, the motor vehicle formed preferably as a car, in particular as a commercial vehicle, comprises the internal combustion engine and can be driven by means of the internal combustion engine. The valve train has at least one first rocker arm. The first rocker arm is mounted on a rocker shaft so as to be pivotable around a pivot axis in relation to the rocker shaft. This means that the valve train has the rocker shaft, which in particular is provided in addition to the first rocker arm and very preferably is formed separately from the first rocker arm, and which is a physical. i.e. physically present component of the valve train. The pivot axis is an imaginary and in particular purely two-dimensional axis, around which the first rocker arm can be pivoted in relation to the rocker shaft, i.e. can be moved in a rotational manner. In contrast to the rocker shaft, the pivot axis is thus not an actually present component, i.e. not a physically present component, but an imaginary straight line, around which the first rocker arm can be pivoted in relation to the rocker shaft. Furthermore, the valve train has a first gas exchange valve which can be actuated by pivoting the first rocker arm around the pivot axis and in relation to the first rocker shaft and thus can be moved translationally. Furthermore, the valve train has a second gas exchange valve, which in particular is provided in addition to the first gas exchange valve and which, as will be explained in further detail below, can also be actuated and can thus be moved translationally. In particular, the respective gas exchange valve can be moved translationally in particular along a movement direction in relation to the rocker shaft, in particular by the actuation of the respective gas exchange valve. Actuation of the respective gas exchange valve can be understood to mean in particular that during the or by the actuation of the respective gas exchange valve, the respective gas exchange valve is moved translationally from a closed position into an open position of the gas exchange valve, in particular in relation to the rocker shaft. In particular, the respective gas exchange valve can be an outlet valve. The respective gas exchange valve is, for example, assigned to a gas channel—in particular of a cylinder head of the internal combustion engine—that is formed in particular as an outlet valve or inlet valve, wherein the respective gas exchange valve closes the respectively assigned gas channel in its respective closed position. In the respective open position of the respective gas exchange valve, the respective gas exchange valve releases the respectively assigned first gas channel. The gas channels are preferably assigned to the same cylinder of the internal combustion engine. Thus, for example, in the respective open position of the respective gas exchange valve, a mixture comprising at least air, for example, can flow into the cylinder via the respectively assigned gas channel (inlet channel) and/or in the respective open position of the respective gas exchange valve, a gas initially received in the cylinder, for example, can flow out of the cylinder via the respectively assigned gas channel (outlet channel). For example, an injector is also assigned to the cylinder, which injector is, for example, designed to introduce an in particular liquid fuel into the cylinder, in particular to directly inject it into the cylinder. The injector is fixed onto the cylinder head, for example.

In order to be able to actuate, in particular open, the two gas exchange valves of a cylinder particularly advantageously, in particular in a fired operation of the internal combustion engine, the valve train has an intermediate piece, formed separately from the first rocker arm and in particular also separately from the rocker shaft, which intermediate piece is mounted on the rocker shaft so as to be pivotable around the pivot axis in relation to the rocker shaft and preferably also in relation to the first rocker arm. The intermediate piece can be actuated by means of the first rocker arm by pivoting the first rocker arm around the pivot axis and in relation to the rocker shaft and can thus be pivoted around the pivot axis in relation to the rocker shaft, whereby the second gas exchange valve can be actuated and can thus be moved translationally. In other words, if the intermediate piece is pivoted around the pivot axis in relation to the rocker arm, in particular in a pivot direction, the second gas exchange valve is actuated as a result and thus moved translationally. In particular, it is provided that the second gas exchange valve can be actuated directly by means of the intermediate piece, so that when the intermediate piece is pivoted around the pivot axis in relation to the rocker shaft, in particular in the pivot direction, the intermediate piece actuates the second gas exchange valve directly. If the first rocker arm is actuated and is thus pivoted around the pivot axis in relation to the rocker shaft, in particular in the pivot direction also referred to as the first pivot direction, the first rocker arm on the one hand actuates the first gas exchange valve, in particular directly. On the other hand, the first rocker arm actuates the intermediate piece, in particular directly, if it is pivoted around the pivot axis in relation to the rocker shaft, in particular in the pivot direction, whereby the intermediate piece is pivoted around the pivot axis in relation to the rocker shaft, in particular in the pivot direction. Thus, the second gas exchange valve can be actuated via the intermediate piece, i.e. with the aid of the intermediate piece by means of the first rocker arm, in particular by pivoting the first rocker arm around the pivot axis and in relation to the rocker shaft, and in particular in the pivot direction.

In order to be able to actuate the gas exchange valves in a particularly advantageous manner, it is provided in one embodiment of the invention that the first rocker arm has a first lever arm for actuating the first gas exchange valve and an intermediate piece actuating region for actuating the intermediate piece. Therefore, the rocker arm with its lever arm and an intermediate piece actuating region spaced apart therefrom can be designed particularly simply and cost-effectively.

A further embodiment is characterised in that the intermediate piece has a third lever arm for actuating the second gas exchange valve and a first actuating region, wherein the first rocker arm with the intermediate piece actuating region actuates the intermediate piece via the first actuating region. Therefore, the intermediate piece with its first actuating region can be designed particularly simply and cost-effectively.

A further embodiment is characterised by a second rocker arm, which is formed separately from the intermediate piece and separately from the first rocker arm and is mounted on the rocker shaft so as to be pivotable around the pivot axis in relation to the rocker shaft. In particular, it is conceivable that the intermediate piece is arranged in the axial direction of the rocker shaft and thus along the pivot axis between the first rocker arm and the second rocker arm.

The intermediate piece can be actuated by means of the second rocker arm, by pivoting the second rocker arm around the pivot axis and in relation to the rocker shaft and in relation to the first rocker arm and in particular in the pivot direction, and can thus be pivoted, in particular in the pivot direction, around the pivot axis in relation to the rocker shaft and in relation to the first rocker arm, whereby the second gas exchange valve can be actuated and can thus be moved translationally, while the first gas exchange valve is not actuated and preferably also the first rocker arm is not pivoted in relation to the rocker shaft and around the pivot axis, in particular in the pivot direction. In other words, if the second rocker arm is pivoted around the pivot axis in relation to the rocker shaft, in particular in the pivot direction, then the second rocker arm actuates the intermediate piece, in particular directly, whereby the intermediate piece is pivoted around the pivot axis in relation to the rocker shaft, in particular in the pivot direction. Therefore, the second gas exchange valve is actuated. The first gas exchange valve is, however, not actuated, meaning that, for example, the first gas exchange valve remains in its closed position, even though the second gas exchange valve is opened. While it is thus possible to actuate the two gas exchange valves, in particular simultaneously, by means of the first rocker arm via the intermediate piece, it is possible to actuate the second gas exchange valve by means of the second rocker arm, via the intermediate piece, without actuating the first gas exchange valve in the process.

In a further embodiment, the intermediate piece has a second actuating region. Furthermore, the second rocker arm with a fourth lever arm actuates the intermediate piece via the second actuating region. Therefore, the intermediate piece has a second actuating region along with the first actuating region and can be actuated in a particularly easy manner by the first rocker arm and the second rocker arm.

Furthermore, it is conceivable that the second rocker arm is a switchable rocker arm. The switchable second rocker arm can be switched, for example, between at least two switching states. In a first of the switching states, by pivoting the switchable second rocker arm around the pivot axis and in relation to the rocker shaft, the second gas exchange valve can be actuated by means of the switchable second rocker arm, in particular in such a way that in the first switching state, the second gas exchange valve can be actuated with the aid of the intermediate piece by means of the second rocker arm. In a second of the switching states, by pivoting the switchable second rocker arm around the pivot axis and in relation to the rocker shaft, the second gas exchange valve can be actuated, for example, without the aid of the intermediate piece by means of the switchable second rocker arm. For example, the second gas exchange valve can be actuated in an engine braking mode of the internal combustion engine by means of the intermediate piece, bypassing the first rocker arm. This means that in a fired operation of the internal combustion engine, the first gas exchange valve is actuated by the first rocker arm and the second gas exchange valve is actuated by the intermediate piece, whereby the intermediate piece is actuated by the first rocker arm to this end. In an engine braking mode, only the second gas exchange valve can be actuated with the aid of the intermediate piece by the second rocker arm in its second switching state, wherein the first rocker arm and therefore the first gas exchange valve is not actuated.

The internal combustion engine can be operated by means of the valve train in an engine braking mode and therefore as an engine brake. The engine brake is preferably formed as a decompression brake, by means of which the motor vehicle can be braked particularly effectively and efficiently, i.e. the speed thereof can be reduced and/or an excessive increase in the speed at which the motor vehicle drives forwards can be avoided. For example, in order to operate the internal combustion engine in the engine braking mode, the second gas exchange valve is actuated in a known manner, in particular in a respective work cycle of the internal combustion engine, while the first gas exchange valve is not actuated. Thus, for example, the second switching state of the switchable second rocker arm is set to carry out the engine braking mode.

The invention is based on the fact that, for example, rocker arms with a more complex structure are used in the known prior art, in order to achieve a fired operation and an engine braking mode. The valve train according to the invention enables a much simpler design of the valve train. It is further known from the prior art. That a valve bridge common to the gas exchange valves can be used to actuate the gas exchange valves by means of a rocker arm via the valve bridge. In this case, the valve bridge is completely spaced apart from the rocker shaft and is not mounted at or on the rocker shaft, but rather the valve bridge is typically only mounted at or on a gas exchange valve or the gas exchange valves. Such a valve bridge can be avoided by the invention, such that corresponding wear and loss of the valve bridge for example by incorrect assembly can also be avoided. In comparison to a conventionally used valve bridge, the intermediate piece can be installed much more easily and therefore more quickly and cost-effectively. To this end, the intermediate piece is, for example, easily plugged onto the rocker shaft, in particular pushed on. Excessive and undesired movements of the intermediate piece can also be avoided by rotatably or pivotably mounting the intermediate piece at the rocker shaft, in particular on the rocker shaft, so that in particular an undesired loss of the intermediate piece can be avoided. Nevertheless, the intermediate piece, like a valve bridge, makes it possible to actuate both the first gas exchange valve and the second gas exchange valve by means of the first rocker arm.

A second aspect of the invention relates to an internal combustion engine for a motor vehicle, comprising a valve train, in particular according to the first aspect of the invention. The valve train according to the second aspect of the invention has at least one rocker arm, also referred to as a first rocker arm, which is mounted on a rocker shaft so as to be pivotable around a pivot axis in relation to the rocker shaft. Thus, the valve train and thus the internal combustion engine also comprise the rocker shaft, which, in contrast to the pivot axis, is a physical component, i.e. a physically present component. The valve train in the second aspect of the invention also comprises a first gas exchange valve and a second gas exchange valve, provided in addition to the first gas exchange valve. The first gas exchange valve can be actuated by pivoting the first rocker arm around the pivot axis and in relation to the rocker shaft, and can thus be moved translationally, in particular from a closed position into an open position.

Now in order to be able to actuate the gas exchange valves in a particularly simple and advantageous manner, it is provided in the second aspect of the invention that the valve train and thus the internal combustion engine have an intermediate piece which is formed separately from the rocker arm and also preferably separately from the rocker shaft and which is mounted on the rocker shaft so as to be pivotable around the pivot axis in relation to the rocker shaft and preferably in relation to the rocker arm, which intermediate piece can be actuated by pivoting the first rocker arm around the pivot axis and in relation to the rocker shaft by means of the first rocker arm and can thus be pivoted around the pivot axis in relation to the rocker shaft, whereby the second gas exchange valve can be actuated and can thus be moved translationally. The first rocker arm can thus actuate the second gas exchange valve via the intermediate piece, and it is preferably provided that the first rocker arm can actuate the first gas exchange valve, bypassing the intermediate piece. Advantages and advantageous embodiments of the first aspect of the invention are to be regarded as advantages and advantageous embodiments of the second aspect of the invention, and vice versa.

Further advantages, features and details of the invention arise from the following description of a preferred exemplary embodiment and with the aid of the drawings. The features and feature combinations mentioned above in the description, as well as the following features and feature combinations mentioned in the figure description and/or shown alone in the figures, can be used not only in the respectively provided combination, but also in other combinations or in isolation, without leaving the scope of the invention.

In the drawings.

In the figures, identical or functionally identical elements are provided with the same reference numerals.

Figure 1:
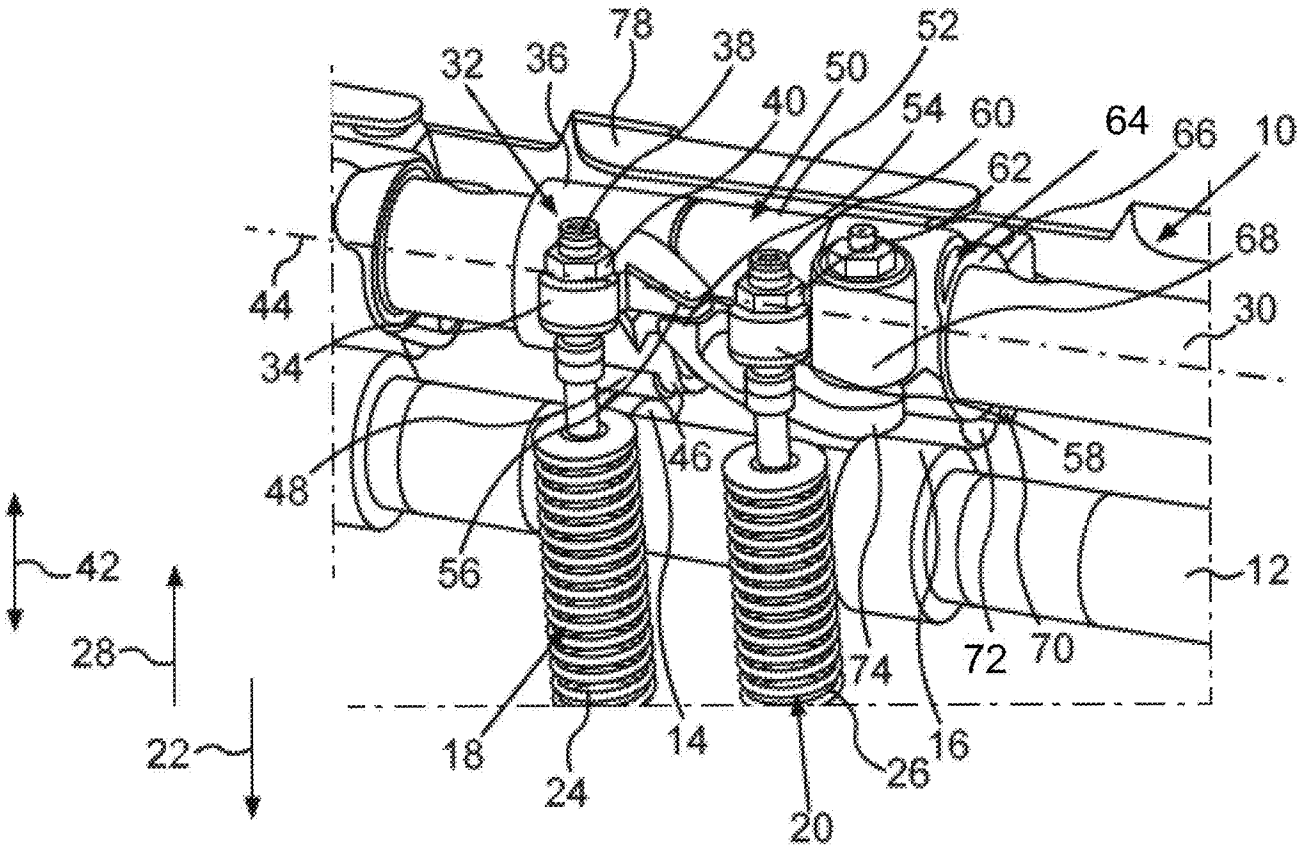
FIG. 1 shows a schematic perspective view of a section of a valve train for an internal combustion engine of a motor vehicle.

FIG. 1 exhibits a schematic perspective view of a section of a valve train 10 for an internal combustion engine-designed as a reciprocating piston engine—for a motor vehicle. The motor vehicle is preferably a car, in particular a commercial vehicle, and when fully assembled it comprises the internal combustion engine, also referred to as a combustion engine or engine, by means of which the motor vehicle can be driven. The internal combustion engine, not shown in detail, has at least one cylinder, in which combustion processes take place during a fired operation of the internal combustion engine. The cylinder is formed for example by a crankcase of the internal combustion engine. Furthermore, the internal combustion engine comprises, for example, a cylinder head formed separately from the crankcase and connected to the crankcase, which cylinder head forms a combustion chamber roof that is assigned to the cylinder. The cylinder and the combustion chamber roof respectively form part of a combustion chamber. The combustion chamber is also partially formed by a piston which is arranged in the cylinder such that it can be moved translationally.

The valve train 10 is shown as an example for the cylinder and has a camshaft 12 which is, for example, rotatably mounted on the cylinder head and thus rotatable around a rotational axis in relation to the cylinder head, and which has a first cam 14 and second cam 16. The valve train 10 also comprises a first gas exchange valve 18 and a second gas exchange valve 20, which are represented in FIG. 1 in sections. The gas exchange valves 18 and 20 are assigned to the same cylinder and thus are common to the aforementioned cylinder. The gas exchange valves 18 and 20 are formed as outlet valves for example. The respective gas exchange valve 18 or 20 is assigned a gas channel which is formed or delimited, for example, by the cylinder head and is an outlet channel for example. The respective gas exchange valve 18 or 20 can be moved at least between a closed position and at least one open position in relation to the cylinder head, in particular translationally. In the respective closed position, the respective gas exchange valve 18 or 20 closes off the respectively assigned outlet channel to the combustion chamber of the cylinder. In the respective open position however, the respective gas exchange valve 18 or 20 releases the respectively assigned outlet channel, so that a gas that was initially received in the combustion chamber of the cylinder can then flow out of the cylinder via the released outlet channel. In this case, the respective gas exchange valve 18 or 20 can be moved translationally in a first movement direction that is illustrated by an arrow 22 in FIG. 1 from the respective closed position into the respective open position in relation to the cylinder head. A first spring 24 or second spring 26, also referred to as a valve spring, is assigned to the respective gas exchange valve 18 or 20. If the respective gas exchange valve 18 or 20 is moved from the respective closed position into the respective open position, i.e. opened, and thus moved in relation to the cylinder head in the first movement direction 22, the respective spring 24 or 26 is tensioned, in particular compressed. As a result, the respective spring 24 or 26 provides a spring force which acts in a second movement direction counter to the first movement direction 22 and illustrated by an arrow 28 in FIG. 1. The respective gas exchange valve 18 or 20 can be moved translationally by means of the respective spring force in the second movement direction 28 from the respective open position into the respective closed position, i.e. it can be closed and in particular held in the respective closed position.

Furthermore, the valve train 10 has a rocker shaft 30 and a first rocker arm 32 in the form of a two-sided lever which is also referred to as an outlet rocker arm. The first rocker arm 32 comprises a first lever arm 34, a first bearing region 36, an adjusting element 38 presently formed as a first adjusting screw, a counter element 40 presently formed as a first locknut. The first adjusting element 38 can, for example, be moved translationally in relation to the first lever arm 34 along an adjustment direction (double arrow 42) that is illustrated in FIG. 1 by a double arrow 42 and runs parallel to the first movement direction 22 and parallel to the second movement direction 28. Therefore, the first adjusting element 38 can be moved along the device (double arrow 42) in relation to the first lever arm 34 into different locations or positions in which the first adjusting element 38 is or can be fixed by means of the first counter element 40 in relation to the first lever arm 34. A known valve clearance on the first gas exchange valve 18 can be set by means of the first adjusting element 38.

The first rocker arm 32 is mounted on the rocker shaft 30 by means of the first bearing region 36 so as to be pivotable around an imaginary and thus not physically present pivot axis 44 in relation to the rocker shaft 30 formed as a physical component. The gas exchange valve 18 can be actuated by pivoting the first rocker arm 32 around the pivot axis 44 and in relation to the rocker shaft 30 and can thus be moved translationally from the closed position into the open position. To this end, a second lever arm 46 with a first cam follower 48 is held in a rotatable manner on the first rocker arm 32, in particular on the first bearing region 36, in the form of a rotatable roller. The first lever arm 34 and the second lever arm 46 are each arranged on opposite ends of the first bearing region 36 of the first rocker arm 32, such that the first bearing region 36 is provided between the first lever arm 34 and the second lever arm 46 thus resulting in a first rocker arm 32 in the form of a two-sided lever. The first cam follower 48 contacts the first cam 14, in particular directly, in particular in such a way that when the camshaft 12 is rotated, the first cam follower 48 rolls on the first cam 14. Thus, the rocker arm 32 can be actuated by means of the cam 14 via the cam follower 48 and can thus be pivoted around the pivot axis 44 in relation to the rocker shaft 30.

In order to be able to realise a particularly advantageous actuation of the gas exchange valve 18 and 20, the valve train 10 has an intermediate piece 50 formed separately from the first rocker arm 32 and also separately from the rocker shaft 30, which intermediate piece 50 is mounted on the rocker shaft 30 so as to be pivotable around the pivot axis 42 in relation to the rocker shaft 30 and also in relation to the first rocker arm 32. To this end, the intermediate piece 50 has a second bearing region 52 which is arranged as viewed in the axial direction of the rocker shaft 30 and thus along the pivot axis 44 next to at least one partial region of the first rocker arm 32, in particular of the first bearing region 36. The intermediate piece 50 can be actuated by means of the first rocker arm 32 by pivoting the first rocker arm 32 around the pivot axis 44 and in relation to the rocker shaft 30 and can thus be pivoted around the pivot axis 44 in relation to the rocker shaft 30, whereby the second gas exchange valve 20 can be actuated and can thus be moved translationally in the first movement direction 22. The intermediate piece 50 has a first actuating region 54 for this purpose.

The first rocker arm 32 actuates the first gas exchange valve 18 via its first lever arm 34. For example, the first lever arm 34 is in contact, in particular direct contact, with the gas exchange valve 18, or the first lever arm 34 can be brought into contact, in particular direct contact, with the gas exchange valve 18 by the first adjusting element 38 by pivoting the first rocker arm 32 around the pivot axis 44 in relation to the rocker shaft 30. Thus, the first rocker arm 32 can actuate the first gas exchange valve 18 via the first lever arm 34 by pivoting the first rocker arm 32 around the pivot axis 44 and in relation to the rocker shaft 30.

Figure 2:
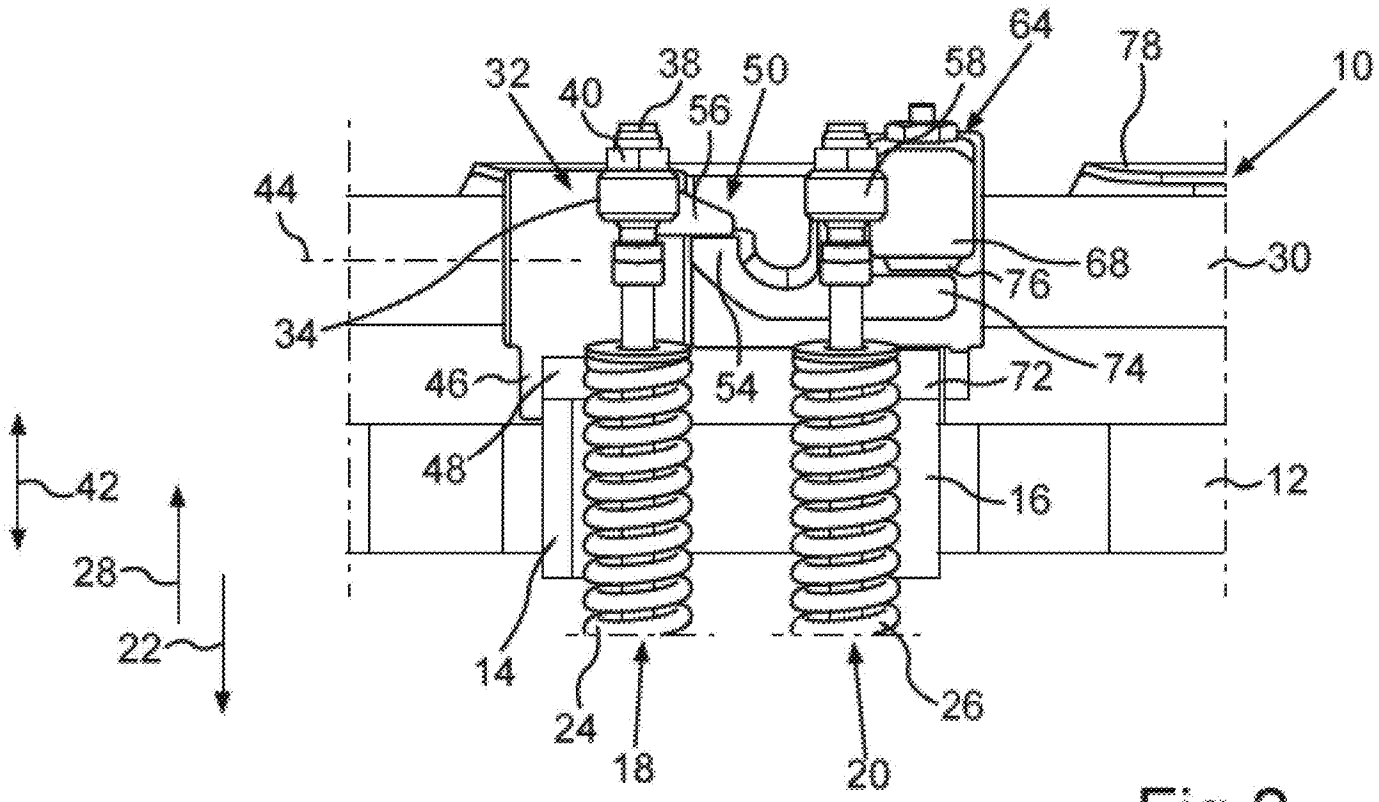
FIG. 2 shows a schematic front view of a section of the valve train according to FIG. 1.
Figure 3:
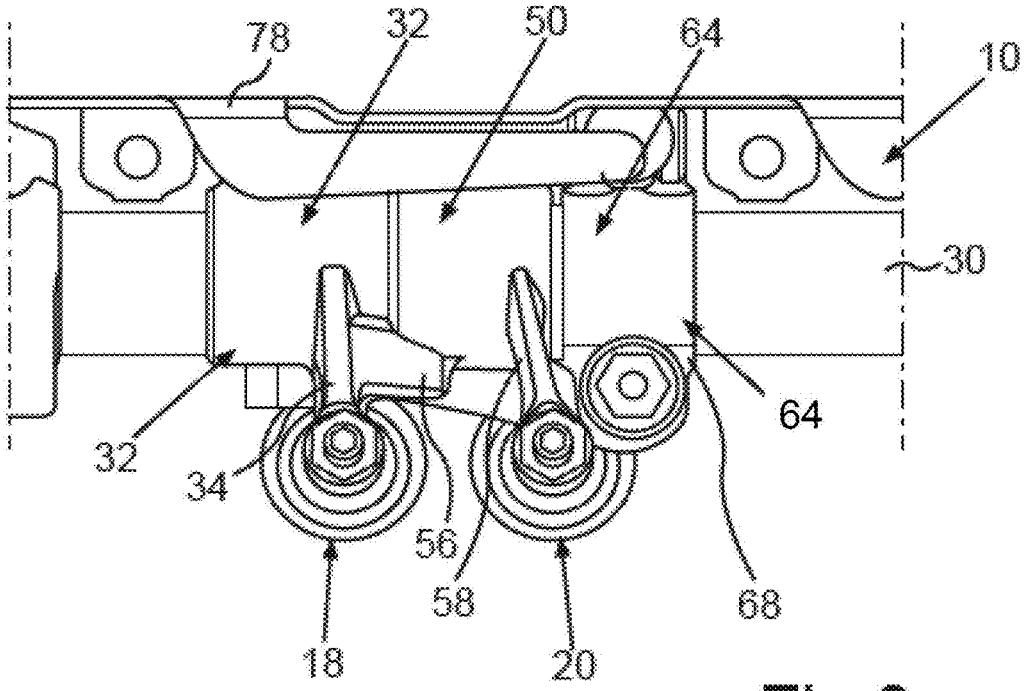
FIG. 3 shows a schematic top view of a section of the valve train according to FIG. 1.

The first rocker arm 32 also has an intermediate piece actuating region 56 which is spaced apart from the first lever arm 34. The intermediate piece actuating region 56 is in contact, in particular in direct contact, with the first actuating region 54 of the intermediate piece 50 or the intermediate piece actuating region 56 can be brought into contact, in particular direct contact, with the first actuating region 54 of the intermediate piece 50 by pivoting the first rocker arm 32 around the pivot axis 44 and in relation to the rocker shaft 30. The first rocker arm 32 can actuate the intermediate piece 50 by pivoting the first rocker arm 32 around the pivot axis 44 and in relation to the rocker shaft 30 via the intermediate piece actuating region 56 and the first actuating region 54 of the intermediate piece 50. The first actuating region 54 of the intermediate piece 50 protrudes from the second bearing region 52 of the intermediate piece 50 in the direction of the gas exchange valves 18 and 20 and can absorb a movement of the first rocker arm 32 in the first movement direction 22. The intermediate piece actuating region 56 of the first rocker arm 32 is arranged such that it projects from the first bearing region 36 in the direction of the gas exchange valve 18 and 20 and protrudes along the pivot axis 44 into the region of the second bearing region 52 of the intermediate piece 50 (FIG. 2), such that the intermediate piece actuating region 56 of the first rocker arm 32 covers or overlaps the first actuating region 54 of the intermediate piece 50 at least partially in the first movement direction 22.

The intermediate piece 50 has a third lever arm 58 which is spaced apart from the first actuating region 54 and the second bearing region 52. The second gas exchange valve 20 can be actuated by means of the intermediate piece 50 via the third lever arm 58, by pivoting around the pivot axis 44 and in relation to the rocker shaft 30, i.e. by actuating the intermediate piece 50. To this end, the third lever arm 58 of the intermediate piece is in contact, in particular direct contact, with the second gas exchange valve 20, or by pivoting the intermediate piece 50 around the pivot axis 44 and in relation to the rocker shaft 30. i.e. by actuating the intermediate piece 50, the third lever arm 58 comes into contact, in particular direct contact, with the second gas exchange valve 20, such that the second gas exchange valve 20 can be actuated by the third lever arm 58 by means of the intermediate piece 50. It can be seen that both gas exchange valves 18 and 20 can be actuated, in particular simultaneously, by means of the first rocker arm 32, i.e. they are actuated when the rocker arm 32 is pivoted around the pivot axis 44 in relation to the rocker shaft 30, i.e. is actuated by means of the cam 14. In this case, the first gas exchange valve 18 can be actuated by means of the first rocker arm 32 and the second gas exchange valve 20 can be actuated by the first rocker arm 32 with its intermediate piece actuating region 56 and by the first actuating region 54 of the intermediate piece 50 by means of the intermediate piece 50. The intermediate piece 50 is thus not actuated by the camshaft 12 via a further lever arm with a further cam follower opposite the third lever arm 58 by means of the camshaft 12 and is thus designed as a one-sided lever.

The intermediate piece 50 has a second adjusting element 60 and a second counter element 62, analogous to the first rocker arm 32 on its third lever arm 58. Analogous to the first adjusting element 38 a known valve clearance can be set on the second gas exchange valve 20 by means of second adjusting element 60).

In the exemplary embodiment shown in the figures, the valve train 10 has a second rocker arm 64 which is formed separately from the intermediate piece 50 and separately from the first rocker arm 32, as well as separately from the rocker shaft 30, and which is provided in addition to the intermediate piece 50 and the first rocker arm 32. The second rocker arm 64 is arranged in the axial direction of the rocker shaft 30, at least partially next to the second bearing region 52 of the intermediate piece 50, wherein the second rocker arm 64 is pivotally mounted on the rocker shaft 30 and the pivot axis 44 in relation to the rocker shaft 30 and also in relation to the first rocker arm 32 and in relation to the intermediate piece 50 via a third bearing region 66. The intermediate piece 50 can be actuated by means of the second rocker arm 64, by pivoting the second rocker arm 64 around the pivot axis 44 and in relation to the rocker shaft 30 as well as in relation to the first rocker arm 32 via a fourth lever arm 68, and can thus be pivoted around the pivot axis 44 in relation to the rocker shaft 30 and in relation to the first rocker arm 32, whereby the second gas exchange valve 20 can be actuated and can thus be moved translationally into the first movement direction 22, while the first gas exchange valve 18 is not actuated and preferably the first rocker arm 32 is not pivoted in relation to the rocker shaft 30 and around the pivot axis 44 either. In this case, a further, fifth lever arm 70 is provided on the second rocker arm 64 along with the fourth lever arm 68. The fifth lever arm 70 of the second rocker arm 64 has a second cam follower 72. The second cam follower 72 is held in a rotatable manner on the fifth lever arm 70, by which the second rocker arm 64 can be actuated by means of the second cam 16 and can thus be pivoted around the pivot axis 44 in relation to the rocker shaft 30. The fourth lever arm 68 and the fifth lever arm 70 are respectively arranged analogously to the first rocker arm 32 on opposite ends of the third bearing region 66 of the second rocker arm 64, such that the third bearing region 66 is provided between the fourth lever arm 68 and the fifth lever arm 70, thus resulting in a second rocker arm 64 in the form of a two-sided lever. If the second rocker arm 64 is thus actuated, in particular by means of the second cam 16, while the first rocker arm 32 is not actuated, i.e. is not pivoted around the pivot axis 44 in relation to the rocker shaft 30, the second rocker arm 64 actuates the intermediate piece 50, which actuates the second gas exchange valve 20, meaning that the second gas exchange valve 20 is actuated with the aid of the intermediate piece 50 by means of the second rocker arm 64, while the first gas exchange valve 18 is not actuated, i.e. while the first gas exchange valve 18 remains in its closed position. As a result, the internal combustion engine is, for example, operated in an engine braking mode and thus as a motor brake, wherein the motor brake is preferably formed as a decompression brake.

In order to actuate the intermediate piece 50 by means of the second rocker arm 64, the intermediate piece 50 has a second actuating region 74, via which the intermediate piece 50 can be actuated by means of the fourth lever arm 68 of the second rocker arm 64. The first actuating region 54 and the second actuating region 74 are spaced apart from each other. The second actuating region 74 of the intermediate piece 50 protrudes from the second bearing region 52 in the direction of the gas exchange valves 18 and 20 and can absorb a movement of the first rocker arm 32 in the first movement direction 22. The second actuating region 74 of the intermediate piece 50 protrudes along the pivot axis 44 into the region of the third bearing region 66 of the second rocker arm 64 (FIG. 2), such that the second actuating region 74 of the intermediate piece 50 and the fourth lever arm 68 of the second rocker arm 64 at least partially overlap in the first movement direction 22. The fourth lever arm 68 of the second rocker arm 32 is arranged such that it projects from the third bearing region 66 in the direction of the gas exchange valves 18 and 20. Thus, the second rocker arm 64 can actuate the intermediate piece 50 via the second actuating region 74 and the fourth lever arm 68. To this end, the second actuating region 74 is for example in contact, in particular in direct contact, with the fourth lever arm 68, or the fourth lever arm 68 can be brought into contact, in particular into direct contact, with the second actuating region 74 by pivoting the second rocker arm 64 around the pivot axis 44 and in relation to the rocker shaft 30, i.e. by actuating the second rocker arm 64.

The cams 14 and 16 are, for example, freely selectable, such that the first cam 14 can be an exhaust cam for example. Since, for example, the braking mode of the internal combustion engine can be realised, i.e. can be carried out, by means of the second cam 16, the second cam 16 is for example formed as a braking cam. Furthermore, it is conceivable that, for example, the second rocker arm 64 is a switchable rocker arm. In this case, a hydraulically actuatable piston 76 can be extended in a braking mode in the first movement direction 22 from the fourth lever arm 68 of the second rocker arm 64 in a known manner and can come into contact with the second actuating region 74 of the intermediate piece 50. The second rocker arm 64 can be switched between at least two switching states, wherein in a first of the switching states, by means of the second rocker arm 64, the second gas exchange valve 20 can be actuated with the aid of the intermediate piece 50 by pivoting the second rocker arm 64 around the pivot axis and in relation to the rocker shaft 30, and in a second of the switching states, by means of the second rocker arm 64, the second gas exchange valve 20 can be actuated without the aid of the intermediate piece 50 by pivoting the second rocker arm 64 around the pivot axis 44 and in relation to the rocker shaft 30. In the first of the switching states, the piston 76 is extended, such that the second gas exchange valve 20 can be actuated. In the second of the switching states, the piston 76 remains retracted in the fourth lever arm 68, such that the second rocker arm 64 is actuated. i.e. can be pivoted, by the second cam 16, but the second gas exchange valve 20 cannot be actuated by means of the pivot movement of the second rocker arm 64.

In the exemplary embodiment shown in the figures, the valve train 10 furthermore has a spring plate 78. The second rocker arm 64 with its second cam follower is held on the second cam 16 using the spring plate 78, such that the second cam follower 72 is permanently in contact with the second cam and rolls on the second cam 16.

REFERENCE NUMERAL LIST

10 Valve train
12 Camshaft
14 First cam
16 Second cam
18 First gas exchange valve
20 Second gas exchange valve
22 First movement direction
24 First spring
26 Second spring
28 Second movement direction
30 Rocker shaft
32 First rocker arm
34 First lever arm
36 First bearing region
38 First adjusting element
40 First counter element
42 Adjustment direction

44 Pivot axis
46 Second lever arm
48 First cam follower
50 Intermediate piece
52 Second bearing region
54 First actuating region
56 Intermediate piece actuating region
58 Third lever arm
60 Second adjusting element
62 Second counter element
64 Second rocker arm
66 Third bearing region
68 Fourth lever arm
70 Fifth lever arm
72 Second cam follower
74 Second actuating region
76 Piston
78 Spring plate

The invention claimed is:

1. A valve train (10) for an internal combustion engine, the valve train comprising:

a first rocker arm (32) pivotally mounted on a rocker shaft (30);

a second rocker arm (64) pivotally mounted on the rocker shaft (30);

an intermediate piece (50) pivotally mounted on the rocker shaft (30) between the first rocker arm (32) and the second rocker arm (64), the intermediate piece configured to be alternately actuated via the first rocker arm (32) and the second rocker arm (64);

a first gas exchange valve (18) configured to be actuated via the first rocker arm (32); and a second gas exchange valve (20) configured to be actuated via the intermediate piece (50), wherein the first gas exchange valve (18) and the second gas exchange valve (20) are simultaneously actuated when the first rocker arm (32) actuates the first gas exchange valve (18) and the intermediate piece (50), and wherein only the second gas exchange valve (20) is actuated when the second rocker arm (64) actuates the intermediate piece (50).

2. The valve train (10) according to claim 1, wherein the first rocker arm (32) includes:

a first lever arm (34) configured to engage the first gas exchange valve (18), and an intermediate piece actuating region (56) configured to engage the intermediate piece (50).

3. The valve train (10) according to claim 2, wherein the intermediate piece (50) includes:

a first actuating region (54) configured to be engaged via the intermediate piece actuating region (56) of the first rocker arm (32), and a third lever arm (58) configured to engage the second gas exchange valve (20).

4. The valve train (10) according to claim 1, wherein:

the second rocker arm (64) includes a fourth lever arm (68) configured to engage the intermediate piece (50).

5. The valve train (10) according to claim 4, wherein:

the intermediate piece (50) includes a second actuating region (74) configured to be engaged via the fourth lever arm (68) of the second rocker arm (64).

6. The valve train (10) according to claim 4, wherein:

the second rocker arm (64) is a switchable rocker arm configured to be switched between at least two switching states including:

a first switching state in which the second rocker arm (64) actuates the second gas exchange valve (20) via the intermediate piece (50)), and a second switching state in which the second rocker arm (64) directly actuates the second gas exchange valve (20).

7. An internal combustion engine for a motor vehicle, the internal combustion engine comprising the valve train (10) of claim 1.

* * * * *